US006652124B2

(12) United States Patent
Schubert et al.

(10) Patent No.: US 6,652,124 B2
(45) Date of Patent: Nov. 25, 2003

(54) LAMP-INDEPENDENT ADJUSTABLE RECESSED LIGHT FIXTURE

(75) Inventors: John S. Schubert, Arlington Heights, IL (US); Joellen S. Lindhorst, Schaumburg, IL (US); David E. Doubek, LaGrange, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/899,533

(22) Filed: Jul. 6, 2001

(65) Prior Publication Data

US 2003/0007354 A1 Jan. 9, 2003

(51) Int. Cl.[7] ..... F21V 21/14

(52) U.S. Cl. ..... 362/285; 362/148; 362/365; 362/429

(58) Field of Search ..... 362/148, 285, 362/365, 426, 427, 429, 145, 147, 257, 287, 362, 364, 368, 370, 382, 418, 419; 248/324, 279.1, 317, 323, 200, 274.1, 276.1, 278.1

(56) References Cited

U.S. PATENT DOCUMENTS 2,069,950 A * 2/1937 Greppin ..... 362/285
2,716,185 A * 8/1955 Burliuk et al. ..... 362/364
3,360,642 A * 12/1967 De Vos et al. ..... 362/285
4,232,361 A * 11/1980 Kelsall ..... 362/285
5,630,663 A * 5/1997 Ling et al. ..... 362/365
5,823,664 A * 10/1998 Demshki et al. ..... 362/427
5,908,236 A * 6/1999 Lueken et al. ..... 362/364
6,036,337 A * 3/2000 Belfer ..... 362/285
6,402,112 B1 * 6/2002 Thomas et al. ..... 248/317

* cited by examiner

*Primary Examiner*—Alan Cariaso
*Assistant Examiner*—Ismael Negron
(74) *Attorney, Agent, or Firm*—Thomas, Kayden, Horstemeyer & Risley LLP

(57) ABSTRACT

An adjustable light fixture includes a fixture assembly, a rotation adjustment assembly, and an angle adjustment assembly. The rotation adjustment assembly is configured to receive a lamp, orient the lamp relative to the fixture assembly, and maintain the orientation of the lamp relative to the fixture assembly when the lamp is removed and replaced. The angle adjustment assembly is movably connected to the fixture assembly and is configured to adjust the angle between the fixture assembly and the rotation adjustment assembly. A method of relamping an adjustable light fixture includes providing an adjustable light fixture, installing a lamp in the rotation adjustment assembly from above or below the adjustable light fixture, and adjusting the rotational or angular orientation of the fixture.

27 Claims, 8 Drawing Sheets

FIG.1D
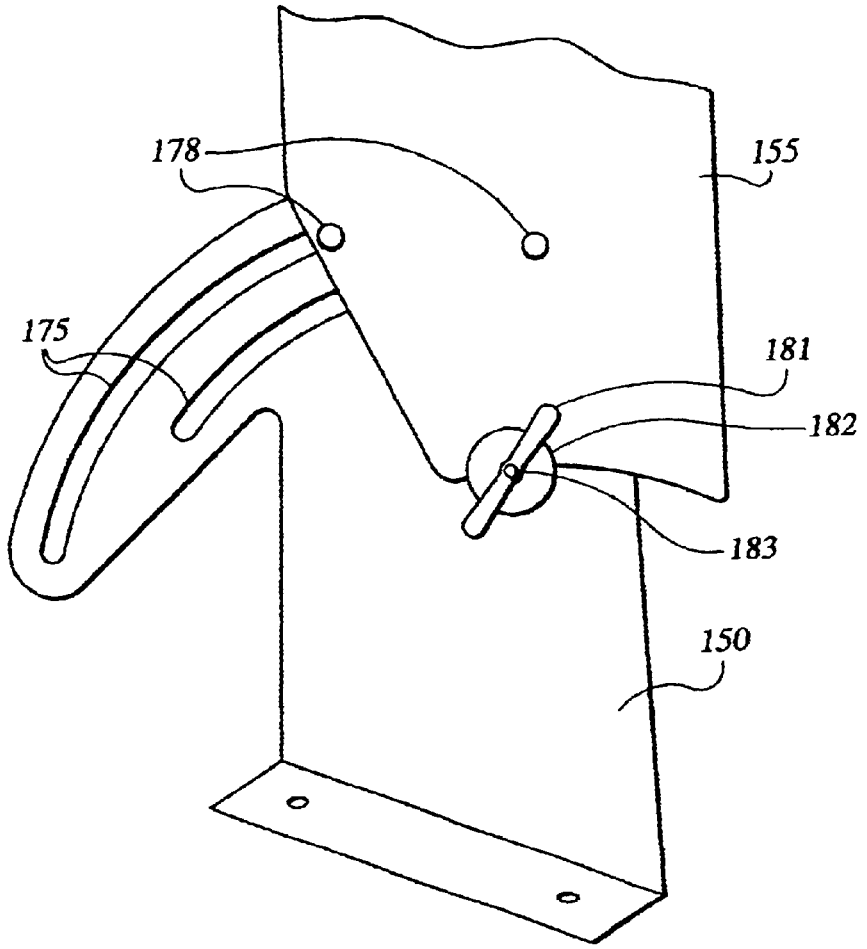
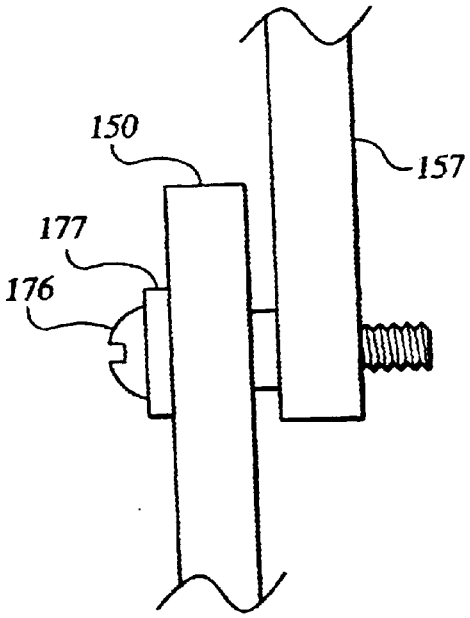
FIG.1E

LAMP-INDEPENDENT ADJUSTABLE RECESSED LIGHT FIXTURE

TECHNICAL FIELD

This invention relates to light fixtures, and more particularly to a light fixture that has relamping and adjustment locks to maintain the angular and rotation orientation of a lamp during relamping.

BACKGROUND

Recessed light fixtures typically include a plaster frame, a can, a lamp holder, and a trim ring that encircles an opening of the can. Recessed light fixtures also may be designed with adjustment features such as a partially closable trim ring and a pivot mechanism to direct the light beam from the enclosed lamp to illuminate a specific area within a room. A light fixture may have the adjustment features set at installation and then may be recessed by mounting the fixture in a ceiling or a wall. Adjustment and maintenance of the recessed light fixture, however, may require access to the light fixture through the ceiling or the wall after it is installed, which can be troublesome and time consuming.

SUMMARY

In one general aspect, a light fixture includes a fixture assembly, a rotation adjustment assembly, and an angle adjustment assembly. The rotation adjustment assembly is configured to receive a lamp, orient the lamp relative to the fixture assembly, and maintain the orientation of the lamp relative to the fixture assembly when the lamp is removed and replaced. The angle adjustment assembly is movably connected to the fixture assembly and is configured to adjust the angle between the fixture assembly and the rotation adjustment assembly.

Implementations of the adjustable light fixture may include one or more of the following features. For example, the rotation adjustment assembly may include a lamp frame, a rotation disc that is rotatably mounted to the lamp frame, and a rotation frame that receives the lamp and is mounted to the rotation disc. One or more clips may be used to fixedly attach the rotation disc to the lamp frame. One or more screws may be threadably inserted into threaded openings in the rotation disc, and may be further received in openings in the rotation frame.

The screws include a first portion having a first screw diameter and a second portion having a larger screw diameter. The openings in the rotation frame may include a first portion having a first opening diameter and a second portion having a second, smaller opening diameter. In this implementation, the second screw diameter is smaller than the first opening diameter in the opening and larger than the second opening diameter in the opening, such that the screw retains the rotation disc to the rotation frame when the screw is positioned in the second portion of the opening.

Clips may be mounted to the rotation adjustment assembly to removably retain a lamp to the rotation adjustment assembly. The clips also may be mounted to the rotation frame.

The rotation frame may include an opening having one or more sets of notches configured to mate with protruding tabs on a lamp.

The angle adjustment assembly may include a fastener and one or more downwardly projecting arms. The downwardly projecting arms rotatably connect to one or more arms extending from the fixture assembly. The fastener fixes the position of one of the downwardly projecting arms relative to the mating arm that extends from the fixture. The downwardly projecting arms may be connected to the rotation adjustment assembly. One or more of the arms extending from the fixture assembly may include an arc portion having at least one slot and one or more of the downwardly projecting arms may include extending members that mate with the slot. When the downwardly projecting arms are moved relative to the arms extending from the fixture assembly, the extending members slidably move within the slots to set an angle of the arms relative to the downwardly projecting arms.

The fastener may be configured to fix the position of an arm extending from the fixture assembly relative to a downwardly projecting arm.

The adjustable light fixture also may have a lens mounting assembly with a lens that is removably mounted to the rotation adjustment assembly. The lens mounting assembly is configured to maintain a constant angular relationship between a lamp mounted in the rotation adjustment assembly and the lens. The lens mounting assembly also is configured such that it can be removed and replaced without affecting the angular relationship between the lamp and the lens.

The lens mounting assembly also may include a lens holder and one or more lens clips. The lens holder retains the lens and includes one or more mounting members. The lens clips mate with the mounting members to retain the lens holder. The lens clips may be mounted to the rotation adjustment assembly and the mounting members may be notches in the lens holder.

The lens holder may be configured to maintain a constant orientation between the lens and the lamp. This feature allows the lens mounting assembly to be removed and replaced without affecting the orientation between the lens and the lamp. One or more clips may be used to fixedly attach the lens to the lens holder.

The lens may have one or more ribbed surfaces and the lens mounting assembly may maintain a constant orientational relationship between the ribbed surface of the lens and the lamp. Moreover, the lens mounting assembly may be removed and replaced without affecting the orientation between the ribbed surface of the lens and the lamp.

In another general aspect, an adjustable light fixture may be relamped by removing a lamp from a rotation adjustment assembly and reinstalling a lamp in the rotation adjustment assembly. The light fixture may include one or more of the features described above. The light fixture also may include one or more of the following features. For example, the rotation adjustment assembly may be configured to receive a lamp, orient the lamp relative to the fixture assembly, and maintain the orientation of the lamp relative to the fixture assembly when the lamp is removed and replaced. The angle adjustment assembly may be moveably connected to the fixture assembly and adjustable to set an angle between the fixture assembly and the rotation adjustment assembly, and may be configured to be adjusted to set an angle between the fixture assembly and the rotation adjustment assembly.

Removing the lamp may include removing the lamp from above the rotation adjustment assembly by loosening screws attaching a rotation frame to a rotation disc and lifting the rotation frame and the lamp away from the angle adjustment assembly. Reinstalling the lamp may include reinstalling the lamp from above the rotation adjustment assembly by aligning the rotation frame holding the lamp with the rotation disc and tightening the screws to attach the rotation frame and the lamp to the rotation disc.

Removing the lamp may include removing the lamp from below the rotation adjustment assembly by pulling the lamp from clips attaching the lamp to the rotation adjustment assembly. Reinstalling the lamp may include reinstalling the lamp from below the rotation adjustment assembly by pushing the lamp into the clips attaching the lamp to the rotation adjustment assembly.

The relamping may further include removing a lens mounting assembly prior to removing the lamp and reinstalling the lens mounting assembly after reinstalling a lamp. The method also may include adjusting a rotational orientation of the lamp relative to the fixture assembly by adjusting the rotation adjustment assembly. Adjusting the rotation adjustment assembly may include mounting the rotation frame to the rotation disc, rotating the rotation disc relative to the lamp frame until a desired rotational orientation is attained, and attaching one or more clips to the rotation disc to fixedly attach the rotation disc to the lamp frame at the desired rotational orientation.

A lamp may be mounted to the rotation frame by inserting the lamp between the clips to retain the lamp with notches of the rotation frame mated with protruding tabs on the lamp. The lamp may be removed from below the light fixture by removing the lamp from the clips.

The lamp may be removed from above the light fixture, such as, for example, from a position above the light fixture in the ceiling plenum. Removing the lamp from above the adjustable light fixture includes rotating the rotation frame relative to the rotation disc until screws in the rotation disc are positioned in the first portion of the openings in the rotation frame, lifting the rotation frame, and removing the lamp from the clips holding the lamp to the rotation frame.

The angle adjustment assembly may be adjusted to set an angle between the fixture assembly and the rotation adjustment assembly. Adjusting the angle adjustment assembly includes moving downwardly projecting arms relative to arms extending from the fixture assembly, slidably moving an extending member within a slot to set an angle of the arm relative to the downwardly projecting arm to set an angle between the fixture assembly and the rotation adjustment assembly, and using a fastener to fix the position of the projecting arm.

The adjustable light fixture is adjustable for a wide range of applications by adjustment of the angular or rotational orientation. After the fixture is fixed in a particular orientation, the fixture may be relamped without changing either the angular or rotational orientation. Relamping may be accomplished by access to the fixture from above the ceiling, such as, for example, in the ceiling plenum, or from below the fixture. These characteristics provide considerable advantage to the recessed light fixture. For example, after a desired illumination configuration has been set between the lamp and the lens by adjusting their angular and rotational orientations, there are great time-savings achieved if the lamp can be easily and quickly replaced without altering the illumination configuration. This light fixture is configured to provide such a relamping.

The details of one or more implementations are set forth in the accompanying drawings and the description below. Other features and advantages will be apparent from the description, the drawings, and the claims.

DESCRIPTION OF DRAWINGS

FIGS. 1B–1E show an angle adjustment mechanism for orienting a lens and a lamp in the recessed light fixture of FIG. 1A.

Like reference symbols in the various drawings indicate like elements.

DETAILED DESCRIPTION

Figure 1A:
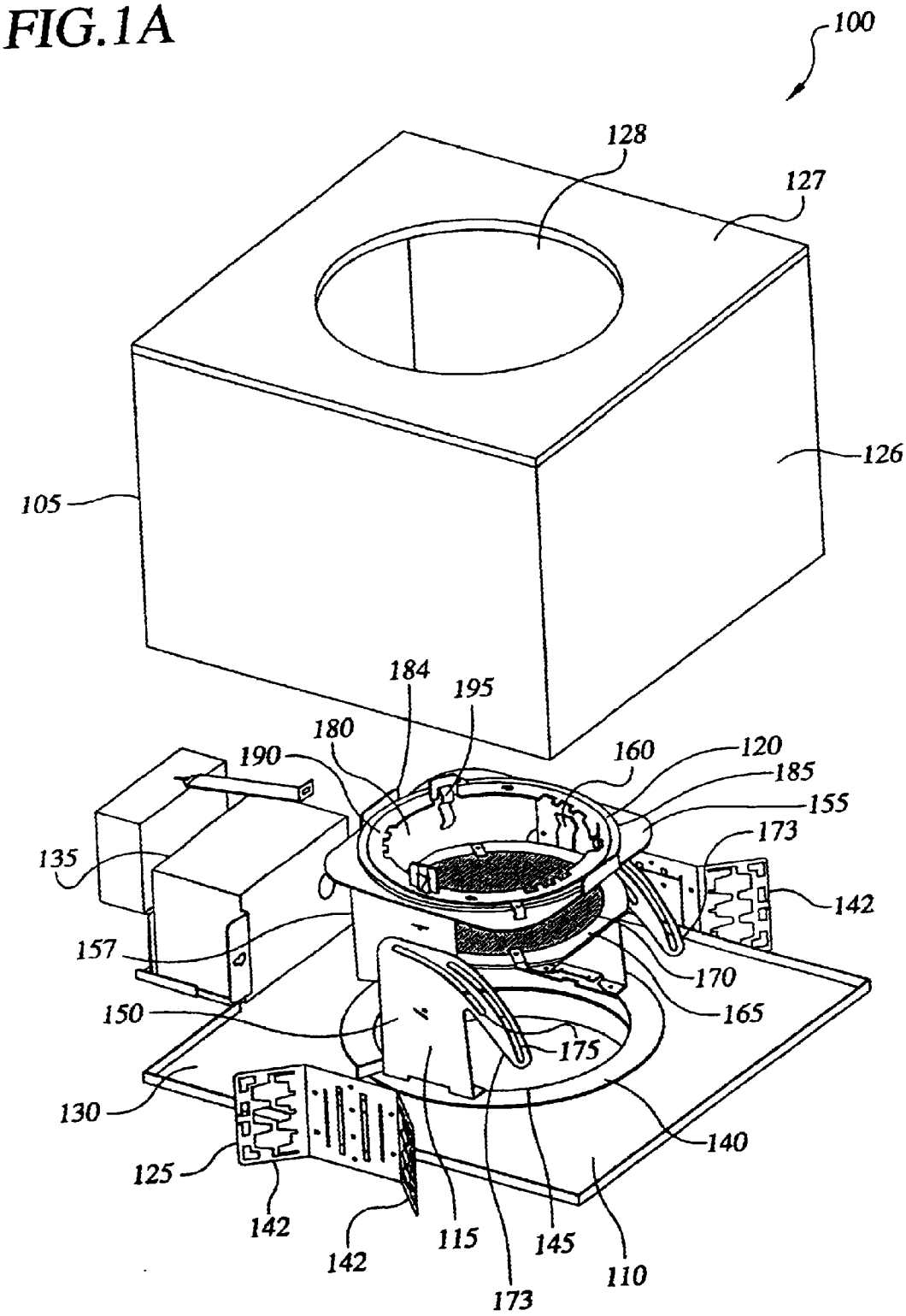
FIG. 1A shows a recessed light fixture.

Referring to FIG. 1A, an adjustable recessed light fixture 100 includes a housing 105, a fixture assembly 110, an angle adjustment assembly 115, and a rotation assembly 120. The angle adjustment assembly 115 provides a mechanism to adjust the angle of a beam of light projecting from a lamp attached to the light fixture. The rotation assembly 120 provides a mechanism to adjust the rotational orientation of the light beam around the angle at which the light beam projects from the lamp. In this regard, a lamp with a non-uniform light pattern can be rotationally oriented in order to attain a desired illumination effect. The angle adjustment assembly 115 and the rotation assembly 120 also are configured such that the lamp and a lens can be removed and a new lamp installed without affecting the angle or the rotational orientation of the lamp and the lens.

The housing mounts to the fixture assembly 110 and encloses the angle adjustment assembly 115, the rotation assembly 120, and a lamp (not shown). Although the housing 105 is illustrated in FIG. 1A as having sides 126 and a top 127 with a circular opening 128, the housing can be configured in any shape that partially or completely encloses the angle adjustment assembly 115 and the rotation assembly 120.

The fixture assembly 110 includes two hanger brackets 125, a plaster frame 130, a junction box 135, and a mounting disc 140. The hanger bracket 125 is a rectangular bracket that includes two bent portions 142 for mounting to ceiling plenums and surfaces of various sizes. The hanger bracket 125 also has multiple cut-outs of different shapes and sizes for mounting with hardware of various sizes. The hanger brackets 125 are mounted to the plaster frame 130.

The plaster frame 130 generally is a square, flat plate with upturned edges against which the housing 105 is flushly mounted. The plaster frame 130 also has a circular fixture aperture 145 sized for passing a lamp through its opening and to provide an illumination pathway. One of the edges of the plaster frame 130 may include holes (not shown) for mounting the junction box 135. The junction box 135 is a metal box with insulated wiring terminals and knock-outs for connecting external wiring.

The mounting disc 140 is a circular disc with a cut-out area or opening of approximately the same diameter as the fixture aperture 145. While the cut-out area generally is circular, the cut-out area has flat or straight portions on each side. The mounting disc 140 has screw holes for mounting the angle adjustment assembly 115.

The angle adjustment assembly 115 includes two adjustment arms 150, a lamp frame 155 having downwardly projecting arms 157, one or more lens clips 160, a lens holder 165, and a lens 170. The lower portion of the adjustment arms 150 have L-shaped ends with holes for mounting to the mounting disc 140. The top portions of the adjustment arms 150 include an arc 173 that projects from one side of the adjustment arm 150 and extends downward. Two elongated, arc-shaped slots 175 are located within the arc 173 of each of the adjustment arms 150.

Figure 1B:
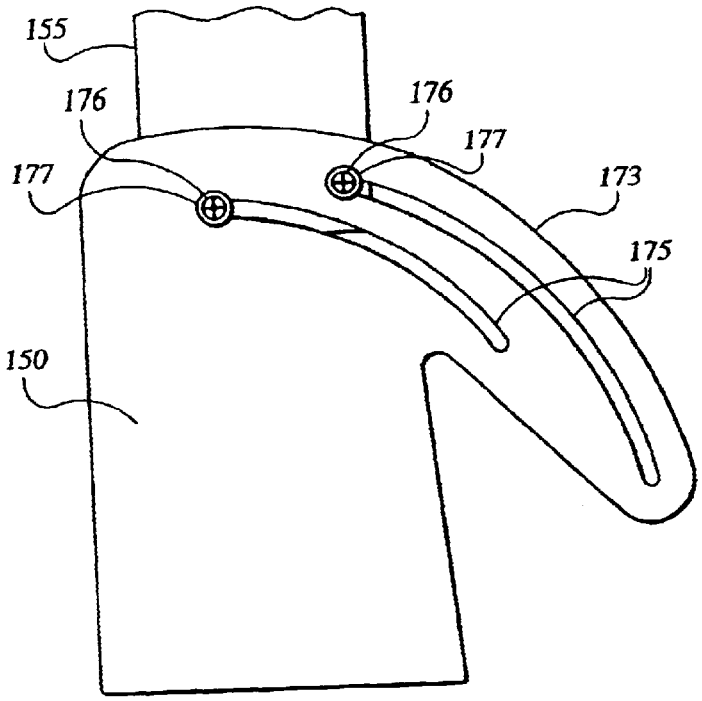
Figure 1C:
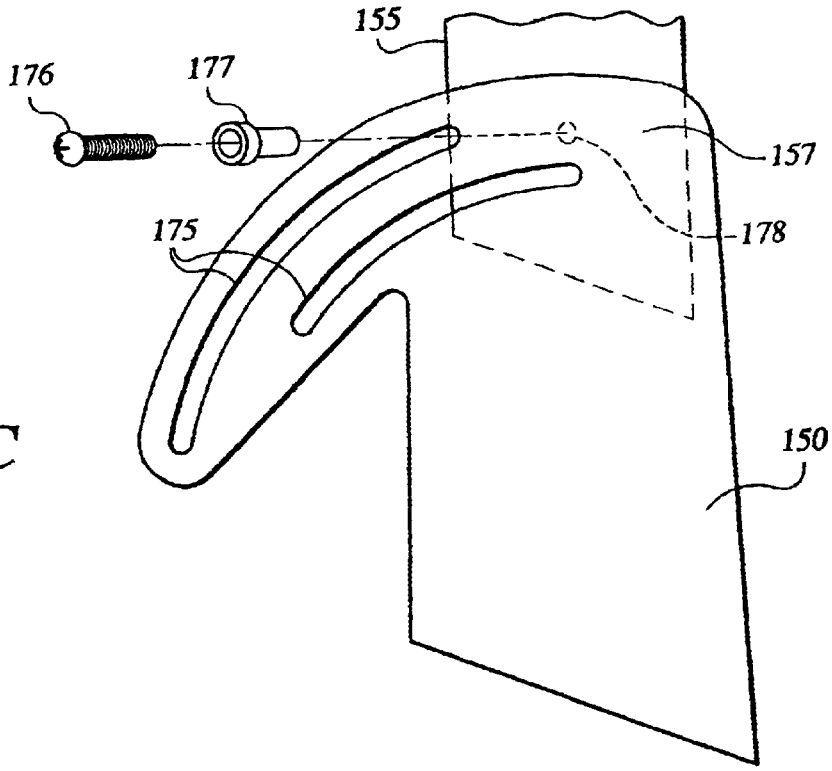

Referring also to FIGS. 1B, 1C, and 1E, the adjustment arms 150 are adjustably mounted to the downwardly projecting arms 157 by screws 176 and nylon spacers 177 that pass through the slots 175 and into screw holes 178 in the downwardly projecting arms. Referring to FIG. 1C, the spacers 177 form a space between the adjustment arms 150 and the downwardly projecting arms such that the screws 176 can be tightened while allowing the lamp frame 155 and downwardly projecting arms 157 to move relative to the adjustment arms 150. Although the spacers are described as being made of nylon, any material that will form a space between the adjustment arms and the downwardly projecting arms can be used. For example, polytetrafluoroethylene, polyethylene, polypropylene, acetyl or other polymer or metal spacers may be used.

Referring also to FIG. 1D, a wing nut 181, a washer 182, and a screw 183 are positioned in one of the adjustment arms 150 at the bottom of the downwardly projecting arms 157. Although FIG. 1D illustrates the wing nut 181, the washer 182, and the screw 183 as being positioned on only one arm 150, a corresponding mechanism can be positioned on the other arm 150 and/or on both arms at the same time. Moreover, any fastening mechanism can be used to fix the position of the arms 150. As illustrated in FIGS. 1A-1D, the downwardly projecting arms 157 are positioned on the inside of the adjustment arms 150. Thus, the head of the wing nut 181 is accessible from the inside surface of the adjustment arm 150 and the head of the screw 183 is accessible from the outside surface of the adjustment arm 150. In this manner, the wing nut 181 can be tightened and loosened from inside of the housing 105 without the housing being removed.

The lamp frame 155 generally is square with an octagonal lamp aperture 180 sized somewhat larger than an installed bulb and with the two downwardly projecting arms 157 connected to the adjustment arms 150. The lamp frame 155, which mounts to the rotation assembly 120, also includes side brackets 184 for alignment of the rotation assembly 120 (FIG. 1A).

The rotation assembly 120 includes a rotation disc 185 and a rotation frame 190. The rotation disc 185 is a circular disk with outside and inside perimeters. The rotation disc 185 is mountable to the rotation frame 190, which also is a circular disk with an outside and an inside perimeter. The rotation frame 190 includes lamp clips 195 for installing a lamp (not shown). As described below, the rotation disc 185 and the rotation frame 190 are mounted to the lamp frame 155 and are used to provide an adjustable fixed orientation of a lamp relative to the light fixture 100. As also described below, the orientation of the lamp is maintained even when a new lamp is installed.

Figure 2A:
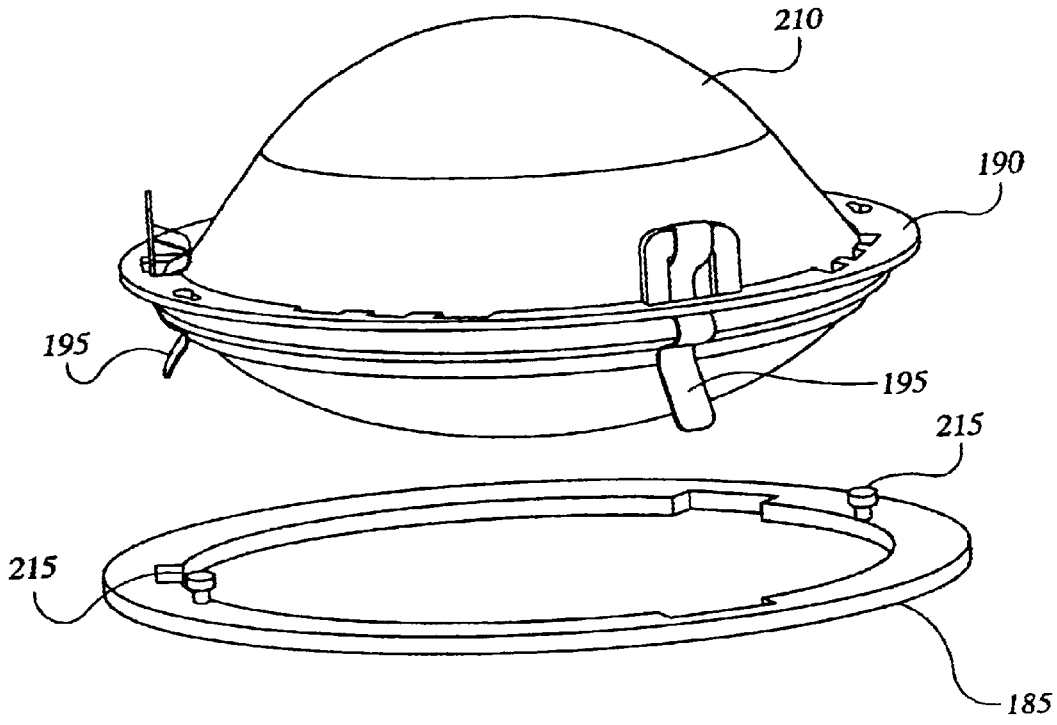
FIGS. 2A–2C show a lamp rotation assembly for use in a recessed light fixture.

Referring to FIG. 2A, the rotation frame 190 holds a lamp 210 with the lamp clips 195 extending around the lamp and being under tension. Thus, the lamp clips 195 must be bent outward under tension to remove the lamp, which can be accomplished by either directly bending the clips or pulling the lamp downward with enough force to overcome the tension imparted by the clips against the lamp. The lamp 210 is held in place between the inside perimeter of the rotation frame 190 and the lamp clips 195. The rotation disc 185 also includes two hex head screws 215 threadably installed in the rotation disc for mounting the rotation frame 190 to the rotation disc.

Figure 2B:
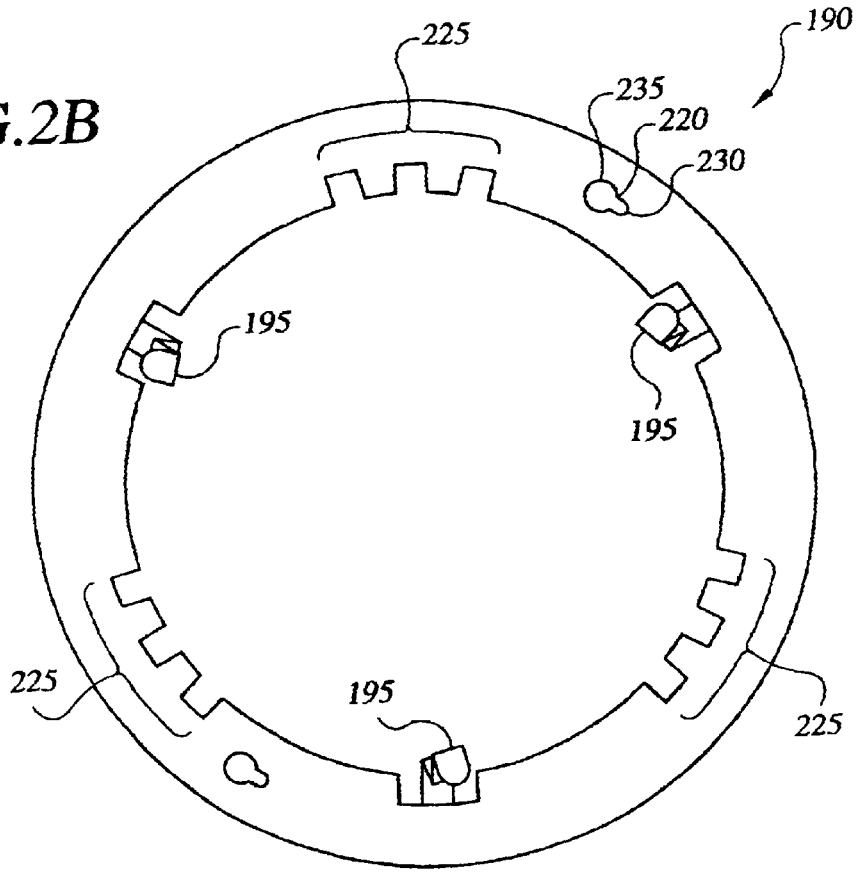

Referring to FIG. 2B, in addition to the lamp clips 195, the rotation frame 190 includes screw holes 220 and three series of three notches 225. The screw holes have a narrow region 230 and a wide region 235. The head of the hex head screw 215 is wider in diameter than the narrow region and narrower in diameter than the wide region 235. The notches 225 align with three series of three protruding tabs (not shown) on the lamp 210 such that the lamp 210 can be installed in the rotation frame 190 in only one orientation.

Figure 2C:
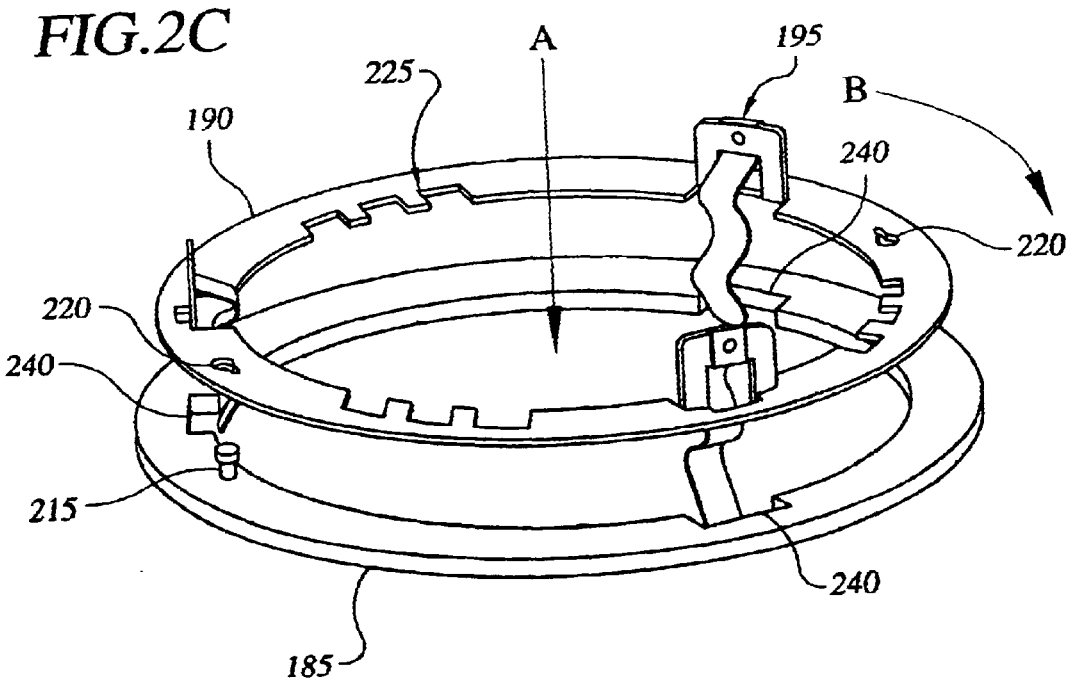

Referring to FIG. 2C, the rotation disc 185 and the rotation frame 190 are assembled by aligning the hex head screws 215 with the wide regions 235 of the screw holes and moving them together in the direction shown by arrow A. Next, the rotation disc 185 and the rotation frame 190 are locked together by rotating the rotation frame 190 in the direction shown by arrow B. Finally, the screws 215 may be tightened down such that the heads of the screws 215 are tightened against the rotation frame 190 to fix the rotation frame to the rotation disc 185. In this manner, the lamp 210 is fixed in the rotation frame 190 in one orientation and the rotation frame also is fixed against the rotation disc 185 in one orientation. As described below, the rotation disc 185, the rotation frame 190, and the lamp 210 are fixed against the lamp frame 155 in a desired orientation such that the orientation of the lamp relative to the lamp frame also is fixed, which is advantageous when the lamp is removed and a new lamp is reinstalled.

Figure 3A:
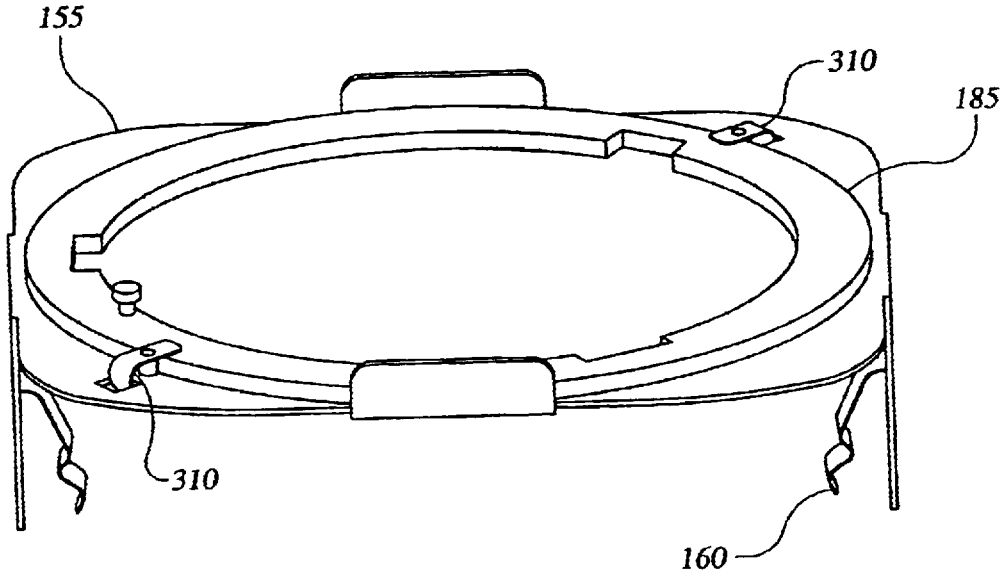
FIGS. 3A and 3B show a lamp frame of the recessed light fixture mounted to a rotation disc with mounting clips.
Figure 3B:
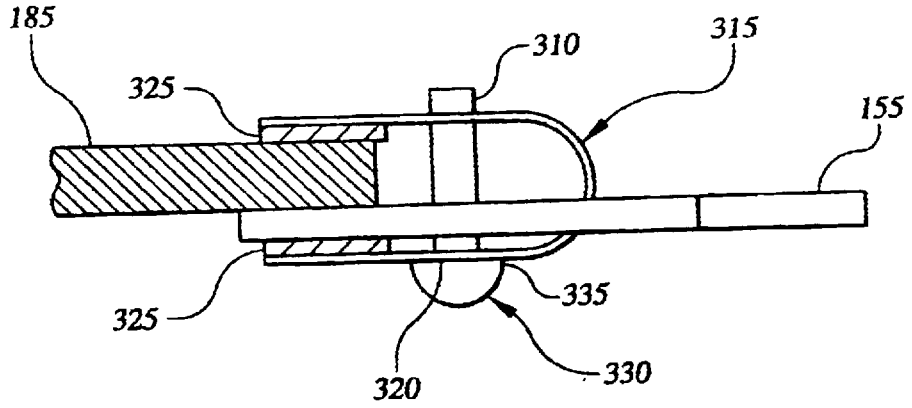

Referring to FIG. 3A, one or more mounting clips 310 are used to attach the rotation disc 185 to the lamp frame 155. Referring to FIG. 3B, each mounting clip 310 includes a U-bracket 315 with a hole 320, bracket pads 325, and a screw 330. The screw 330 has a head 335 that faces downward for access through the fixture aperture 145 shown in FIG. 1. The rotation disc 185, typically with the rotation frame 190 and the lamp 210 attached, is placed on the lamp frame 155 and rotated until the desired orientation of the lamp is attained. The desired orientation is based on the lamp's lens and varies with the rotational orientation of the lamp. Thus, for a desired illumination effect, the lamp can be activated and rotated until the desired illumination is attained. The mounting clips 310 then are moved into a position such that the bracket pads 325 are placed against the lamp frame 155 and the rotation disc 185, and the screws 330 are tightened. In this manner, the orientation of the lamp relative to the light fixture is set and the lamp can be easily removed and replaced without affecting the orientation.

Figure 4A:
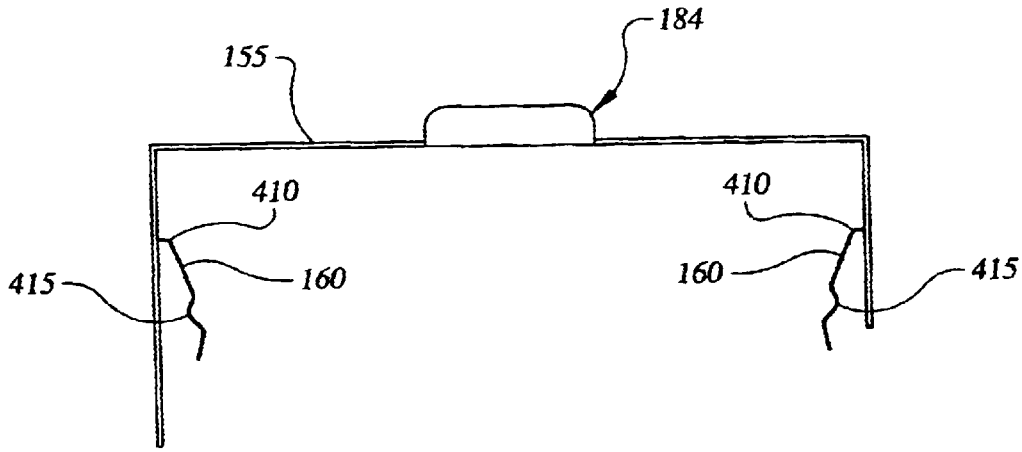
FIGS. 4A and 4B show a lens holder for the recessed light fixture attached to a lamp frame with lens clips.

Referring to FIG. 4A, the lens holder 165 (not shown) attaches to the lamp frame 155 by mounting the lens holder in the lens clips 160. The lens clip 160 is a flexible metal strip with a bend 410 and a recessed area that forms a knee 415. The bend 410 directs the lens clip 160 downward and the knee 415 provides an area to securely retain the lens holder 165 under tension between the lens clips 160.

Figure 4B:
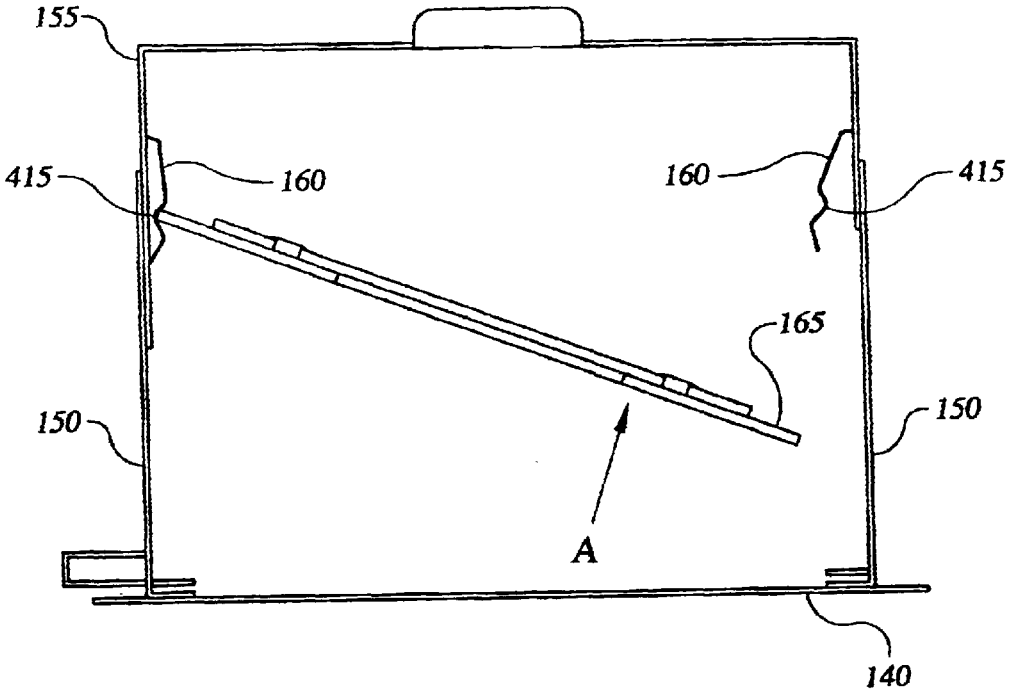

Referring to FIG. 4B, the lens holder 165 is shown with one end installed in the knee 415 of one of the lens clips 160. The lens holder 165 is installed into the knee 415 by moving the lens holder 165 in the direction shown by arrow A while simultaneously pushing the lens holder in the direction of the first lens clip 160 to put the first lens clip under compression. Similarly, the lens holder 165 may be removed from the lens clips 160 by pulling the lens holder 165 out of the knees 415.

Figure 5A:
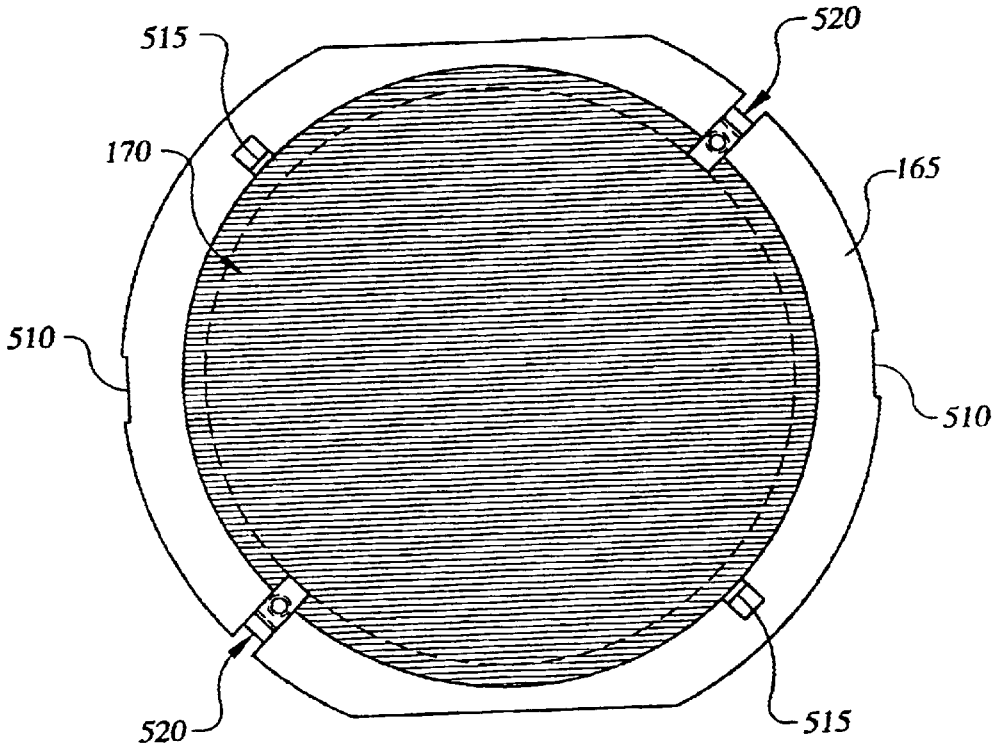
FIGS. 5A and 5B show a lens holder for the recessed light fixture with a lens installed using lens clips.

Referring to FIG. 5A, one or more lens slots 510 are used to align the lens holder 165 when it is being installed in the knees 415 of the lens clips 160. The lens slots 510 provide a fixed orientation of the lens holder 165 relative to the light fixture 100 and prevent the lens holder from being rotated under the lamp. The lens holder 165 retains the lens 170 using retaining stops 515 and retaining clips 520. The retaining stops 515 are raised portions on the lens holder that contact the lens 170 and help center the lens against the lens holder.

Figure 5B:
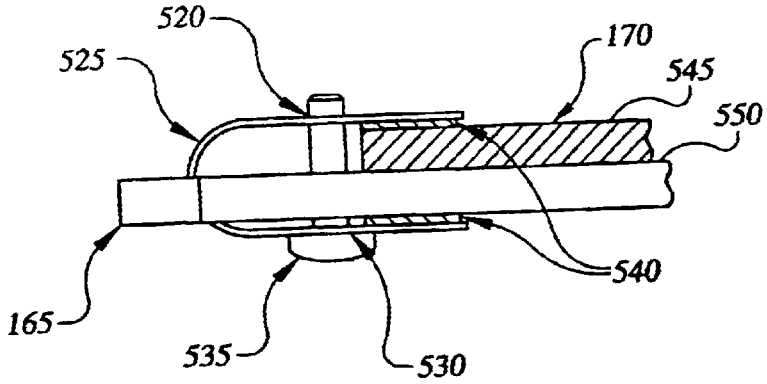

Referring to FIG. 5B, each of the retaining clips 520, which attach the lens holder 165 to the lens 170, includes a U-shaped clip bracket 525 with a hole 530, a clip screw 535 that passes through the hole 530, and a pair of clip pads 540. The lens 170 may have a ribbed side 545 and a flat side 550, with the ribbed side 545 facing away or downward from the lens holder 165. With the lamp positioned in a set position using the method described above and the lens holder 165 mounted in the lens clips 160, the lens 170 can be rotated relative to the lens holder and the lamp until the desired illumination effect is attained. The U-shaped clip brackets 525 then are placed over the lens 170 and the lens holder 165 such that the pads 540 are in contact with the lens and the lens holder, and the clip screw 535 is tightened. In this manner, the lens 170 is in a fixed relationship with the lens holder 165, which is in a fixed relationship with the light fixture 100. Moreover, the lens 170 is in a fixed relationship with the lamp 210. With these fixed relationships, the lens and the lens holder can be removed as a unit and the lamp can be removed and replaced without affecting the orientation of the lamp or the lens.

The recessed light fixture 100 can be installed in a plenum area of a ceiling. The hanger brackets 125 can be mounted to support structures in the plenum. In addition, the plaster frame 130 rests on the ceiling and may be affixed to the ceiling or its support members.

A lamp 210 can be installed in the recessed light fixture 100 from above or below the ceiling. The lamp 210 can be installed from below the ceiling through the aperture 145 in the plaster frame 130. With the lens holder 165 and the lens 170 removed, the lamp is inserted through the aperture 145, the protruding tabs on the lamp are aligned with the notches 225 on the rotation frame 190, and the lamp is pushed into the lamp clips 195 to install the lamp. Next, the lens holder 165 is inserted through the aperture 145 and pushed into the lens clips 160 on the lamp frame 155 to install the lens holder 160.

The lamp 210 can be installed from above the ceiling from the plenum area. First, the rotation frame 190 is removed from the light fixture 100 by loosening the hex head screws 215 that hold the rotation frame 190 to the rotation disc 185. The rotation frame 190 then is rotated slightly to align the hex head screws 215 with the wide regions 235 of the screw holes 220 and the rotation frame 190 is lifted off of the rotation disc 185. Next, the protruding tabs on the lamp are aligned with the notches 225 on the rotation frame 190 and the lamp is pushed into the lamp clips 195 to install the lamp in the rotation frame. Finally, the rotation frame 190 with the lamp is reinstalled in the light fixture 100. The rotation frame 190 is positioned above the light fixture 100 and the wide regions 235 of the screw holes 220 in the rotation frame 190 are aligned with the hex head screws 215 on the rotation disc 185. The rotation frame 190 is lowered onto the rotation disc 185 and the rotation frame 190 is rotated until the hex head screws are aligned with the narrow regions 230 of the screw holes 220. The hex head screws 215 then are tightened to fix the rotation frame 190 and lamp to the light fixture 100.

The angular orientation of the lamp 210 and the lens 170 also can be adjusted from inside the light fixture 100 (from below) or from outside the light fixture 100 (from the ceiling plenum area). Adjustment of the orientation angle from the inside of the light fixture 100 is performed by loosening the wing nut 181, adjusting the lamp frame 155 relative to the adjustment arms 150, and retightening the wing nut. Adjustment of the orientation angle from the outside of the light fixture 100 is performed by loosening the screw 183, adjusting the lamp frame 155 relative to the adjustment arms 150, and retightening the screw 183. After the orientation angle is set, the lamp 210 and the lens 170 may be removed or installed without disturbing the preset positions. Adjustment of the orientation angle may be performed with or without the lamp 210 and the lens 170 installed.

A number of implementation of the recessed light fixture 100 have been described. Other implementations are within the scope of the following claims.

What is claimed is:

1. A light fixture comprising:

a fixture assembly;

an angle adjustment assembly movably connected to the fixture assembly, the angle adjustment assembly configured to move rotationally relative to the fixture assembly; and a rotation adjustment assembly movably connected to the angle adjustment assembly, the rotation adjustment assembly configured to move angularly relative to the angle adjustment assembly;

the angle adjustment assembly further configured to maintain a fixed angle between the rotation adjustment assembly and the fixture assembly;

the rotation adjustment assembly further configured to rotationally orient a lamp relative to the fixed angle and to maintain a fixed rotational orientation relative to the fixed angle;

whereby the rotation adjustment assembly maintains the fixed rotational orientation when the lamp is replaced with another lamp.

2. The light fixture of claim 1, further comprising a lens mounting assembly comprising a lens and being removably mounted to the rotation adjustment assembly and configured to maintain a constant rotational orientation between a lamp mounted in the rotation adjustment assembly and the lens, such that the lens mounting assembly can be removed and reinstalled without affecting the constant rotational orientation between the lamp and the lens.

3. The light fixture of claim 2, wherein the lens mounting assembly further comprises:

a lens holder configured to retain the lens and including a mounting member; and at least one clip configured to mate with the mounting member to retain the lens holder on the rotation adjustment assembly.

4. The light fixture of claim 3, wherein the at least one clip is mounted to the rotation adjustment assembly.

5. The light fixture of claim 3, wherein the mounting member comprises a notch in the lens holder.

6. The light fixture of claim 3, wherein the lens holder includes at least one lens clip configured to attach the lens to the lens holder to maintain the constant rotational orientation between the lamp and the lens.

7. The light fixture of claim 6, wherein the lens has at least one ribbed surface and the lens mounting assembly maintains a constant rotational orientation between the ribbed surface of the lens and the lamp, such that the lens mounting assembly can be removed and reinstalled without affecting the constant rotational orientation between the ribbed surface of the lens and the lamp.

8. The light fixture of claim 1, wherein the angle adjustment assembly comprises:

a downwardly projecting arm connected to the rotation adjustment assembly;

an arm extending from the fixture assembly, the downwardly projecting arm angularly connected to the arm extending from the fixture assembly; and a fastener configured to fix the angular position of the downwardly projecting arm relative to the arm extending from the fixture assembly.

9. The light fixture of claim 8, wherein:

the fixture assembly comprises two arms extending from the fixture assembly, each arm including an arc portion having two slots; and the angle adjustment assembly comprises two downwardly projecting arms, wherein each downwardly projecting arm includes two extending members that mare with the two slots of a respective arm extending from the fixture assembly such that when the downwardly projecting arm is moved relative to the arm extending from the fixture assembly, the extending members slidably move within the slots to adjust an angle of the arm extending from the fixture assembly relative to the downwardly projecting arm.

10. The light fixture of claim 8, wherein the arm extending from the fixture assembly includes an arc portion having a slot and the downwardly projecting arm includes an extending member that mates with the slot, such that moving the downwardly projecting arm relative to the arm extending from the fixture assembly slidably moves the extending member within the slot to adjust an angle of the downwardly projecting arm relative to the arm extending from the fixture assembly.

11. The light fixture of claim 10, wherein the fastener is further configured to fix the position of the downwardly extending arm relative to the arm extending from the fixture assembly.

12. The light fixture of claim 1, wherein the rotation adjustment assembly comprises a lamp frame, a rotation disc configured to be rotatably oriented on the lamp frame, and a rotation frame configured to removably retain the lamp and to be mounted to the rotation disc.

13. The light fixture of claim 12, further comprising at least one clip configured to maintain the rotation disc at a fixed rotational orientation relative to the lamp frame.

14. The light fixture of claim 12, wherein the rotation frame includes an opening and the opening includes at least one set of notches configured to mate with protruding tabs on a lamp.

15. The light fixture of claim 12, further comprising at least one screw configured to be threadably inserted into at least one threaded opening in the rotation disc, wherein the rotation frame includes at least one opening configured to receive at least a portion of the screw.

16. The light fixture of claim 15, wherein:

each screw includes a first portion having a first screw diameter and a second portion having a second larger screw diameter;

each opening in the rotation frame includes a first portion having a first opening diameter and a second portion having a second, smaller opening diameter; and the second screw diameter is smaller than the first opening diameter and larger than the second opening diameter, such that the screw is configured to retain the rotation frame to the rotation disc when the screw is positioned in the second portion.

17. The light fixture of claim 12, further comprising at least two clips mounted to the rotation adjustment assembly and configured to removably retain a lamp to the rotation adjustment assembly.

18. The light fixture of claim 17, wherein the clips are mounted to the rotation frame.

19. A method of relamping a light fixture comprising:

providing a light fixture including:

a fixture assembly;

an angle adjustment assembly movably connected to the fixture assembly, the angle adjustment assembly configured to move rotationally relative to the fixture assembly; and a rotation adjustment assembly movably connected to the angle adjustment assembly, the rotation adjustment assembly configured to move angularly relative to the angle adjustment assembly;

the angle adjustment assembly further configured to maintain a fixed angle between the rotation adjustment assembly and the fixture assembly;

the rotation adjustment assembly further configured to rotationally orient a lamp relative to the fixed angle and to maintain a fixed rotational orientation relative to the fixed angle;

whereby the rotation adjustment assembly maintains the fixed rotational orientation when the lamp is replaced with another lamp;

removing the lamp from the rotation adjustment assembly; and reinstalling another lamp in the rotation adjustment assembly.

20. The method of claim 19, wherein:

providing a light fixture further comprises providing a rotation adjustment assembly having a lamp frame, a rotation disc configured to be rotatably oriented on the lamp frame, and a rotation frame configured to removably retain the lamp and to be removably mounted to the rotation disc;

removing the lamp further includes removing the rotation frame from the rotation disc and removing the lamp from the rotation frame; and reinstalling another lamp further includes retaining another lamp on the rotation frame and mounting the rotation frame to the rotation disc.

21. The method of claim 19, wherein:

removing the lamp includes removing the lamp from clips attaching the lamp to the rotation adjustment assembly; and reinstalling another lamp further includes inserting another lamp into the clips attaching the lamp to the rotation adjustment assembly.

22. The method of claim 19, wherein:

providing a light fixture further comprises providing a lens mounting assembly removably mounted to the rotation adjustment assembly;

removing the lamp further comprises removing the lens mounting assembly prior to removing the lamp; and reinstalling another lamp further comprises reinstalling the lens mounting assembly after reinstalling the lamp.

23. The method of claim 19, further comprising adjusting an angular orientation of the rotation adjustment assembly relative to the fixture assembly.

24. The method of claim 23, wherein:

providing a light fixture further comprises providing an angle adjustment assembly having at least one downwardly projecting arm connected to the rotation adjustment assembly, at least one arm extending from the fixture assembly, the at least one downwardly projecting arm angularly connected to the at least one arm extending from the fixture assembly, and a fastener configured to fix the position of the downwardly projecting arm relative to the arm extending from the fixture assembly;

adjusting the angular orientation of the rotation adjustment assembly relative to the fixture assembly comprises:

moving the downwardly projecting arm relative to the arm extending from the fixture assembly to adjust an angle between the rotation adjustment assembly and the fixture assembly; and fastening the fastener to maintain the angular orientation of the rotation adjustment assembly relative to the fixture assembly.

25. The method of claim 19, further comprising adjusting a rotational orientation of the lamp relative to the rotation adjustment assembly.

26. The method of claim 25, wherein:

providing a light fixture further comprises providing a rotation adjustment assembly having a lamp frame, a rotation disc configured to be rotatably oriented on the lamp frame, a rotation frame configured to removably retain the lamp and to be mounted to the rotation disc, and at least one clip configured to maintain the rotation disc at a fixed rotational orientation relative to the lamp frame; and adjusting the rotational orientation of the lamp relative to the rotation adjustment assembly comprises:

retaining the lamp on the rotation frame;

mounting the rotation frame to the rotation disc;

orienting the rotation disc on the lamp frame;

rotating the rotation disc relative to the lamp frame until a desired rotational orientation is attained; and attaching the at least one clip to the rotation disc to maintain the fixed rotational orientation of the rotation disc relative to the lamp frame.

27. The method of claim 26, wherein:

providing a light fixture further comprises providing the lamp frame with an opening with a set of notches configured to mate with tabs on the lamp and at least two clips mounted to the rotation frame and configured to removably retain a lamp to the rotation frame; and mounting the lamp to the rotation frame comprises inserting the lamp between the clips and mating the set of notches with the protruding tabs on the lamp.

* * * * *